US007833038B1

(12) United States Patent
King, Jr. et al.

(10) Patent No.: US 7,833,038 B1
(45) Date of Patent: Nov. 16, 2010

(54) INLINE PUSH-IN WIRE CONNECTORS

(76) Inventors: Lloyd Herbert King, Jr., 394 Larimore Valley Dr., Chesterfield, MO (US) 63005; John Lloyd King, Timbervalley Ct., Chesterfield, MO (US) 63017; William Hiner, 8 Briarcastle Ct., O'Fallon, MO (US) 63366

( * ) Notice: Subject to any disclaimer, the term of this patent is extended or adjusted under 35 U.S.C. 154(b) by 0 days.

(21) Appl. No.: 12/798,516

(22) Filed: Apr. 6, 2010

Related U.S. Application Data

(60) Provisional application No. 61/212,216, filed on Apr. 8, 2009.

(51) Int. Cl.
*H01R 13/52* (2006.01)

(52) U.S. Cl. ..... 439/276; 439/936; 439/439

(58) Field of Classification Search ..... 439/439, 439/787, 436, 276, 936
See application file for complete search history.

(56) References Cited

U.S. PATENT DOCUMENTS 3,340,496 A * 9/1967 Kennedy ..... 439/723
4,973,263 A * 11/1990 Nielsen ..... 439/438
4,998,894 A * 3/1991 Gronvall ..... 439/521
5,205,757 A * 4/1993 Hertelendy ..... 439/441
5,828,005 A * 10/1998 Huynh-Ba et al. ..... 174/92
6,007,356 A * 12/1999 Stein ..... 439/284
6,746,286 B2 * 6/2004 Blaha ..... 439/787
6,981,890 B2 * 1/2006 Cutler et al. ..... 439/441
7,255,592 B1 * 8/2007 Tseng ..... 439/439
7,281,942 B2 * 10/2007 Swedberg et al. ..... 439/441
7,507,106 B2 * 3/2009 Keswani et al. ..... 439/439
7,507,126 B2 * 3/2009 King et al. ..... 439/778
7,527,509 B1 * 5/2009 Bethurum et al. ..... 439/153

* cited by examiner

*Primary Examiner*—Briggitte R Hammond
(74) *Attorney, Agent, or Firm*—Jacobson & Johnson

(57) ABSTRACT

A inline push-in wire connector for forming an inline electrical connection or a side-by-side branch connection with either or all of the electrical connections formed therein may be waterproofed through a sealant that retains itself therein but yields to allow insertion of a wire into engagement with a bus strip in the presence of the sealant while the sealant is self healing to form an inline or branch wire connection.

15 Claims, 4 Drawing Sheets

INLINE PUSH-IN WIRE CONNECTORS

CROSS REFERENCE TO RELATED APPLICATIONS

This application claims priority from provisional application 61/212,216 titled Inline Push-In Wire Connector filed Apr. 8, 2009.

FIELD OF THE INVENTION

This invention relates generally to inline push-in wire connectors and, more specifically, to inline push-in wire connectors and waterproof inline push-in wire connectors.

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the disadvantages with numerous types of wire connectors is that the wires must be placed in a parallel condition before the wires can be connected to each other. In addition some wire connectors require that the wires be connected with a special tool i.e., a wire crimping tool. Other methods include joining the wires by soldering or the like. In some cases once a connection is made it is difficult to attach a further wire to the connector. The invention described herein includes features which overcome disadvantages associated with prior art wire connectors by providing an easy and quick to use inline push-in wire connector.

SUMMARY OF THE INVENTION

An inline push-in wire connector wherein a single or multiple connections can be formed on the go including an inline electrical connection where two or more electrically wires are axially inserted into wire ports located on opposite ends of the inline push-in wire connector. Other types of connections that can be formed with the inline push-in wire connector include, a side-by-side connection or a branch connection either in a waterproof condition or a non-waterproof condition.

DESCRIPTION OF THE PREFERRED EMBODIMENT

Figure 1:
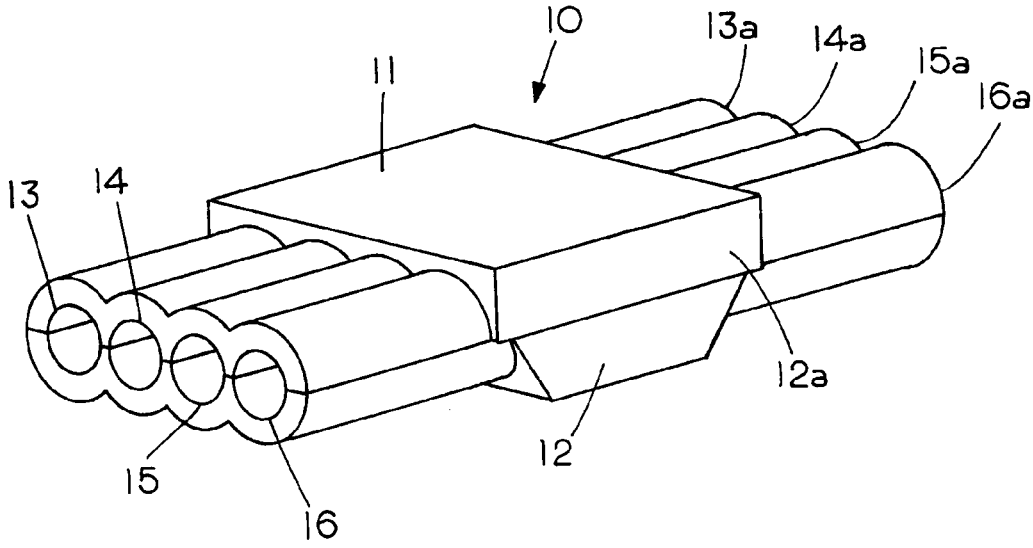
FIG. 1 shows a perspective view of an inline push-in wire connector.
Figure 2:
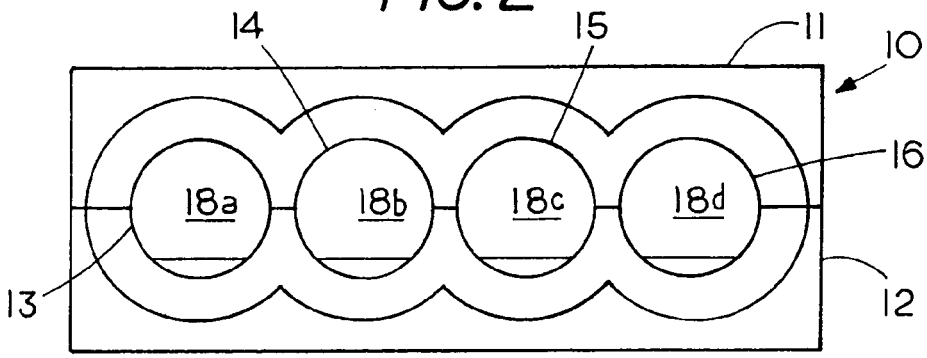
FIG. 2 shows an end view of an inline push-in wire connector of FIG. 1.

FIG. 1 shows a perspective view of an inline push-in wire connector 10 having a split housing 11 formed by an upper member 12*a* and a lower member 12 which are both formed from an electrical insulating material. Located in a side-by-side position on one end of inline push-in wire connector 10 is a set of four extensions_each containing a wire socket or wire port. FIG. 1 and FIG. 2 show a first wire socket 13, a second wire socket 14, a third wire socket 15 and a fourth wire socket 16 with each of the sockets terminating in a cavity i.e. 18*a*, 18*b*, 18*c* and 18*d* in housing 11 (see FIG. 2). Similarly, located in a side-by-side position on the opposite end of inline push-in wire connector 10 are a second set of four extensions each containing a wire socket or wire port. That is, push in wire connector 10 includes a first wire socket 13*a*, a second wire socket 14*a*, a third wire socket 15*a* and a fourth wire socket 16*a* with each of the sockets also terminating in cavities in housing 11. Sockets 13 and 13*a* are in substantial axial alignment with each other as are sockets 14 and 14*a*, 15 and 15*a*, and 16 and 16*a*. Each of the sockets forms a wire passageway to receive an electrical wire or wires. The placement of the extensions with wire sockets ports located on the opposite side of the housing 11 allows one to form inline or end-to-end electrical connections without having to bend or bring electrical wires into a parallel condition before joining the electrical wires. That is two or more wires can be joined as part of an inline circuit by having the wires located an end-to-end condition using push-in wire connector 10.

Figure 3:
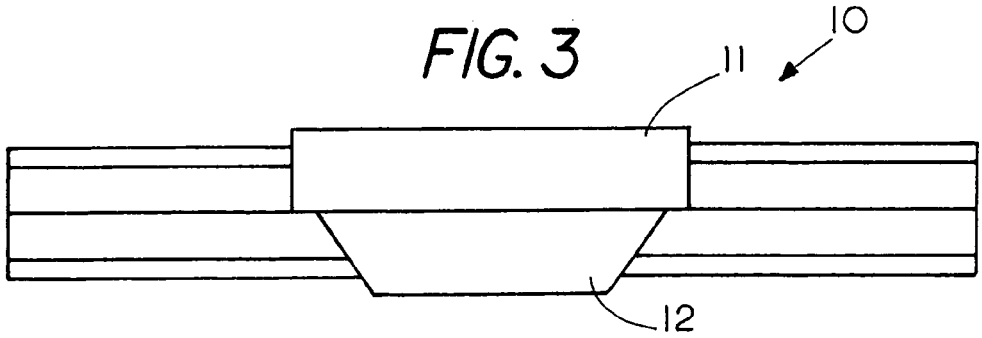
FIG. 3 shows a side view of an inline push-in wire connector of FIG. 1.
Figure 4:
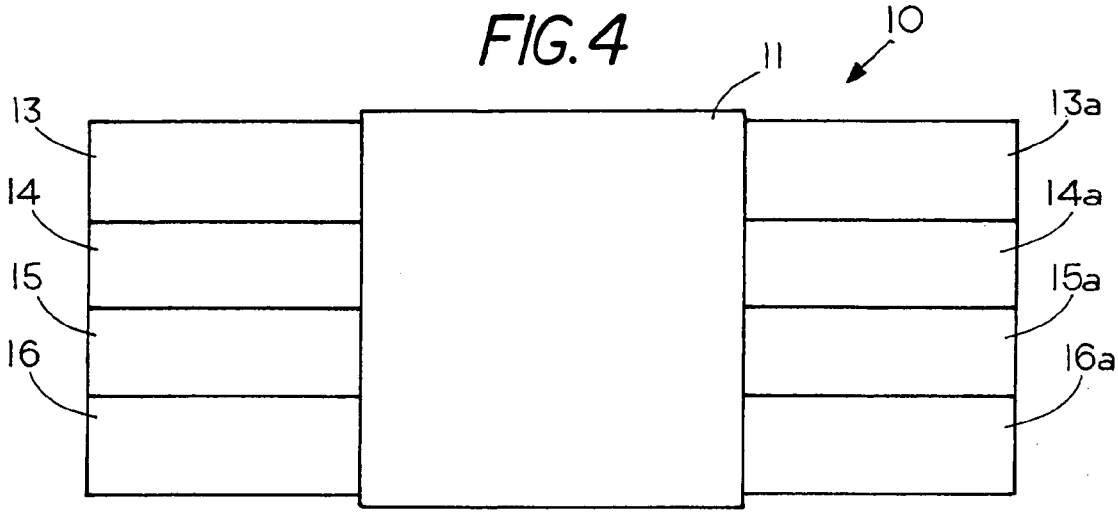
FIG. 4 shows a top view of an inline push-in wire connector of FIG. 1.

FIG. 2, FIG. 3 and FIG. 4 show respectively an end view, a side view, and a top view of the inline push-in wire connector 10.

In operation of the inline push-in wire connector 10 a first bared wire end may be axially inserted into the socket 13 and into engagement with a bus strip 19*a* therein to form electrical contact with the bus strip 19*a* in chamber 18*a* and a second wire, which is to be electrically joined to the first wire, may be axially inserted into the opposite wire socket 13*a* and into engagement with bus strip 19*a* in chamber 18*a* in the inline push-in connector. Similarly, a third bared wire end may be axially inserted into the socket 14 and into engagement with a further bus strip in chamber 18*b* to form electrical contact with the further bus strip therein and a fourth wire, which is to be electrically joined to the third wire, is inserted into the wire socket 14*a* and into engagement with the further bus strip in chamber 18*b*. Additional wires may be connected in a similar manner through sockets 15, 15*a* and 16 and 16*a*. No folding or bending of the wires is required since the electrical wires can be axially inserted directly into ports that are inline with the original orientation of the wires in the circuit. In this embodiment each of the sockets or passageways are electrically isolated from each other to enable forming four different end to end electrical connections in the same connector. It is within the spirit and scope of he invention to have a connector with more or less ports for connecting electrical wires in an inline condition. For example, in some cases one may have an inline connector for a single wire.

The inline push-in wire connector 10 allows one to insert electrical wires into separate sockets and quickly form the wires into electrical contact with each other while maintaining the original axial orientation of each of the wires. That is, the wires need not be placed parallel to each other and joined in a twisting and side-by-side connection by connectors such as twist-on wire connectors, however, a feature of the present is that the user retains the option of being able to place and connect wires either parallel to each other or in an end-to-end condition as described hereinafter. When a sealant is located in the chamber or chambers of the inline wire connector one has the advantage of forming a waterproof inline wire connector by axially inserting a wire into the inline wire connector 10.

Figure 5:
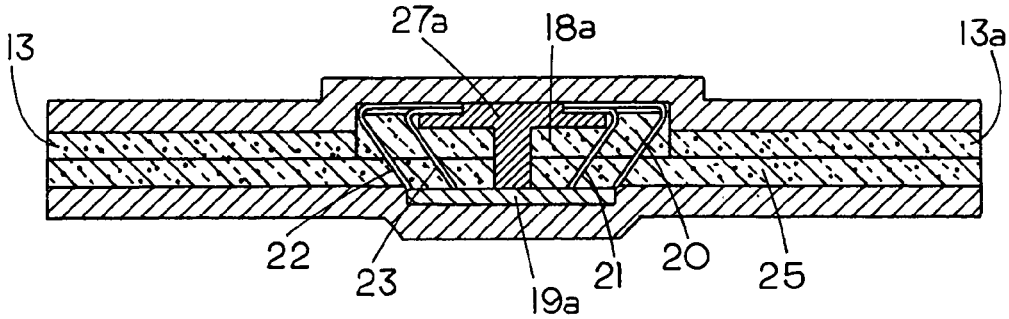
FIG. 5 shows a cross sectional view of the inline push-in wire connector of FIG. 1

FIG. 5 shows a cross sectional view of the inline push-in wire connector 10 taken through ports 13 and 13*a* to reveal a chamber 18 within push-in wire connector 10. Located in the chamber 18 and held in position by housing 11 is an electrical bus strip 19*a* which is accessible from opposed ports of the push in wire connector 10. Positioned proximate to one end of the bus strip 19*a* is a first resilient member 22 having an edge for engaging an electrical wire and a second resilient member 23 having an edge for engaging an electrical wire inserted into port 13 and positioned proximate to the other end of the bus strip 19*a* is a first resilient member 20 having an edge for engaging an electrical wire and a second resilient member 21 having an edge for engaging an electrical wire inserted into port 13*a*. The resilient members 20 and 21 are positioned so as to extend over at least a portion of the opening in port 13*a*. Similarly, the resilient spring members 22 and 23 are positioned so as to extend over at least a portion of the opening in port 13.

Located in chamber 18 is a sealant 25 for waterproofing the bus strip 19 and the spring conductors 20, 21, 22, and 23. As can be seen in FIG. 5 the sealant 25 encompasses the exposed electrically conducting components. The resilient members 20 and 21 are positioned so as to extend over at least a portion of the opening in port 13*a* so that a wire inserted therein enters into electrical engagement with the resilient members 20 and 21 as well as bus strip 19*a* in the presence of a sealant 25. Similarly the resilient members 22 and 23 are positioned so as to extend over at least a portion of the opening in port 13 so that a wire inserted therein enters into electrical engagement with the resilient members 22 and 23 as well as bus strip 19*a* in the presence of a sealant 25.

Also located in chamber 18*a* is a tee shaped separator or wire stop 27*a* that extends across chamber 18*a* and allows one to abut the ends of the wires there against as they are inserted into the opposing ports 13 and 13*a* thus avoiding accidentally inserting one of the wires to deep into the port as well as alerting the operator that the wires are properly extended into the respective wire sockets.

While two resilient members are shown in connector 10, typically, in each socket in push-in wire connector 10 there is at least one resilient member with a common bus strip extending from the end of one socket to the end of the opposed socket so that two or more wires can be electrically joined in an end-to-end condition by merely inserting a bare end of an electrical wire into opposing wire sockets in housing 11 or in a side-by-side condition if the ports have a single common bus strip (for example, sockets 13 and 14) by inserting ends of electrical wires into adjacent sockets on the same side of the push-in wire connector 10.

In the push-in wire connector 10 one may have a single common bus strip 19*a* which extends past the ends of each of ports 13, 13*a*, 14, 14*a*, 15, 15*a*, 16 and 16*a* so that an electrical connection can be formed with the wires in either a side-by-side condition or an end-to-end condition or if desired a branch connection can be formed. As an alternative each of the opposing ports may have a separate bus strip so that each of the sets of opposing ports can be electrically isolated from an adjacent set of opposing ports.

In the embodiment shown a sealant 25, which can be an electrically insulating sealant, is located in the chamber 18*a* and surrounds the resilient members, which are located within the housing 11 to waterproof the electrical connections with the wires. While a sealant may or may not be used, however, if one wants to waterproof the electrical connector the sealant 25 can be placed in the chamber within inline push-in wire connector 10. A further advantage of using a sealant is that in the event that not all the ports are used in the wire connector the sealant in the wire chamber protects the bus strips and the resilient member therein from exposure to the atmosphere.

Different sealants, which are sufficiently viscous to remain in the connector may be used. One type of sealant that works well is, a gel sealant that comes in liquid form i.e. an uncured state. The gel sealant in the uncured or liquid state is poured or placed into the cavity in the inline push-in connector containing a moveable part such as a resilient member. Since the sealant is in liquid form with low viscosity the sealant flows around any movable parts, i.e. the resilient member in the inline push-in wire connector. Once in position the sealant sets or cures to form a gel waterproof sealant that has sufficient cohesiveness so as to self retain itself within the connector but at the same time a gel sealant is capable of yielding in response to insertion of a wire therein as well as self healing to form a waterproof cover around the electrical wire inserted therein. To ensure that no pockets of air are retained in the cavity the air can be removed before inserting the gel in liquid form therein. As an alternate form an opening can be placed in the top portion of the housing so that air is forced out as the gel sealant in liquid form is injected therein. Curable gels generally comprise two parts that are mixed either insitu in the wire connector cavity or are mixed before placing the curable gel in the cavity. This allows the gel while still in the liquid state to flow around and encapsulate the components in the cavity including the moving part or parts of the wire connector.

While the inline push-in wire connector 10 is shown with a sealant therein it is envisioned that the inline push-in wire connector 10 may be also used without a sealant.

In forming an inline or end-to-end connection an electrical wire having a bared end is axially inserted into a socket 13 until the wire end engages the blades or resilient members 22 and 23, which may be electrical conductors. As the wire end is forced through the port 13 the engagement with the resilient members 22 and 23 force the wire end into pressure contact with the bus strip 19*a* to make electrical contact between the wire and the common bus strip 19*a*. The positioning of the blades of the spring conductors at an angle prevents accidental withdrawal of the wire as the edge can bite into the electrical wire. In addition the resilient members maintain contact pressure to ensure electrically continuity to the bus strip 19*a*. Next, an electrical wire having a bared end is axially inserted into a socket 13*a* which is directly opposite of socket 13 until the wire end engages the resilient members 20 and 21, which may be electrical conductors to complete the electrical connection to bus strip 19*a* by forcing a wire end into pressure contact with the bus strip 19*a* to make electrical contact between the wire and the common current plate or bus strip 19*a*.

A further feature of the invention is the ability to form a side-by-side connection with the same connector that is used to form end-to-end connections. In forming a side-by-side electrical connection a first wire is inserted into port 13 and a second wire is inserted into port 14, which is, located parallel to and next to port 13. Each of the wires forms an electrical contact through the resilient members 22 and 23 and bus strip 19*a*.

Still a further feature of the invention is the ability to quickly form a branch connection if the bus strip 19*a* is common to wire sockets 13, 14, 15, 16, 13*a*, 14*a*, 15*a* and 16*a*. In this condition one can quickly form a branch connection by axially inserting wires into any or all of the available wire sockets.

Thus in the embodiment of FIG. 1, if the bus strip 19*a* is common to all the ports an electrical connection can be made in either an inline mode or a side-by-side mode or both thus providing flexibility to the user in fitting the electrical wire connector into the existing wire circuits. On the other hand if the bus strips are isolated to opposed ports a plurality of separate end to end connections can be made in the same connector.

Figure 6:
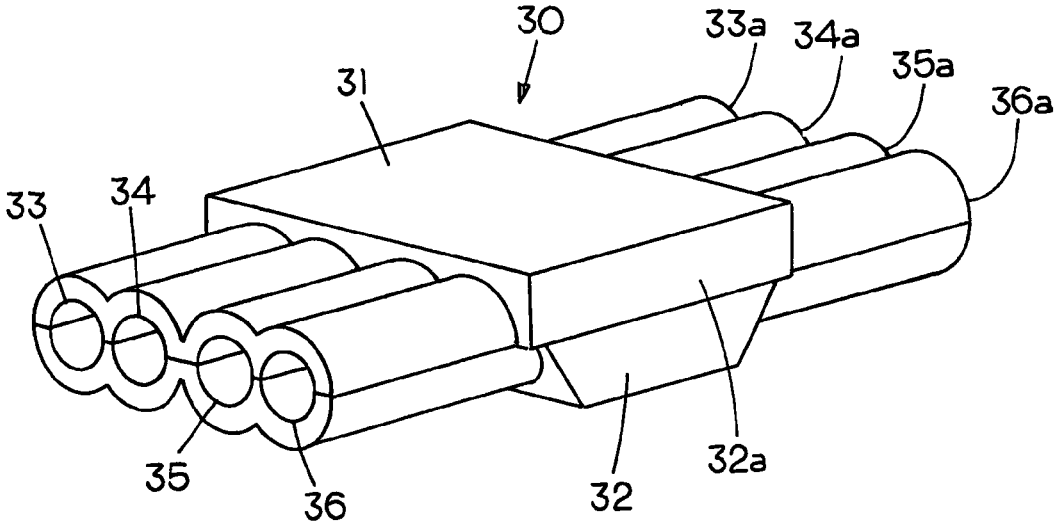
FIG. 6 shows a perspective view of another example of an inline push-in wire connector.

FIG. 6 shows a perspective view of another example of inline push-in wire connector 30 having a split housing 31 formed by an upper member 32*a* and a lower member 32. Located in a side-by-side position on one end of inline push-in wire connector 30 are a first pair of side-by-side wire passageways comprising wire socket 33 and wire socket 34 joined to a first chamber in housing 31 and a second pair of side-by-side wire sockets comprising wire socket 35 wire socket 36 with each of the sockets joined to a second separate chamber in housing 31.

Sockets 33 and 33*a* are in substantial axial alignment with each other as are sockets 34 and 34*a*, 35 and 35*a*, and 36 and 36*a*. By substantial axial alignment it is meant that the wires extending in a first direction from one side of the wire connector and extend in an opposite direction from the other side of the wire connector. The axial alignment or substantial axial alignment of ports or passageways on the opposite side of the housing 31 allows one to form inline electrical connections without having to fold the wires into a parallel condition and then capping with a twist-on wire connector. Push-in wire connector 30 differs from push-in wire connector 10 in that the internal connections within the housing 31 allow one to electrically isolate wires in one pair of sockets from wires another pair of adjacent sockets.

Figure 7:
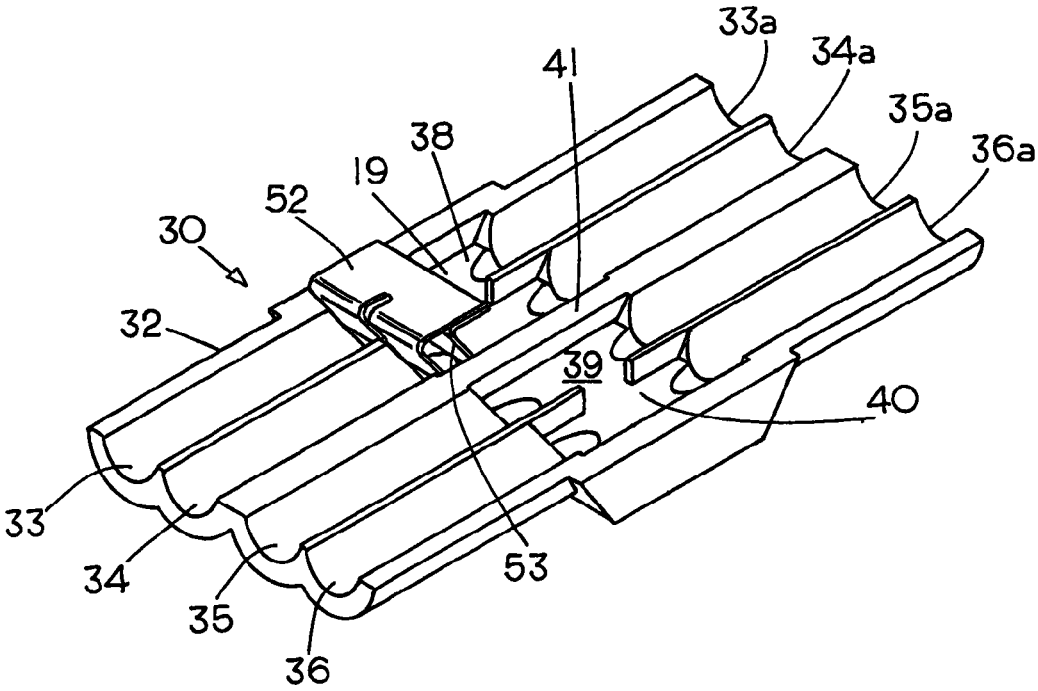
FIG. 7 shows a partial cross sectional view of the inline push-in wire connector of FIG. 6.

FIG. 7 shows a partial perspective view of push-in wire connector 30 with upper member 31 removed to reveal two interior chambers 38 and 39, which are located at the internal ends of the respective passageways of connector 30. In order to reveal the interior of the inline push in wire connector 30 only a portion of a set of resilient members 52 and 53 are shown. The resilient members located in chamber 39 have been left out for purposed of clarity. Located in chamber 39 is a common bus plate or strip 40 that on one side extends past the internal ends of passageway 35 and 36 and on the opposite side extends past the internal ends of passageway 35*a* and 36*a* to form electrical connections between electrical wires located in passageways 35, 36, 35*a* and 36*a*.

Located in chamber 38 is a common bus plate or bus strip 19 that on one side extends past the internal ends of passageway 33 and 34 and on the opposite side extends past the internal ends of passageway 33*a* and 33*a*. In this embodiment bus strip 19 and bus strip 40 are electrically isolated from each by an electrically insulating divider 41 that electrically isolates bus strip 40 from bus strip 19. The electrically isolation permits the connector to be used with two different wires of a circuit for example a hot wire and a ground wire.

Figure 8:
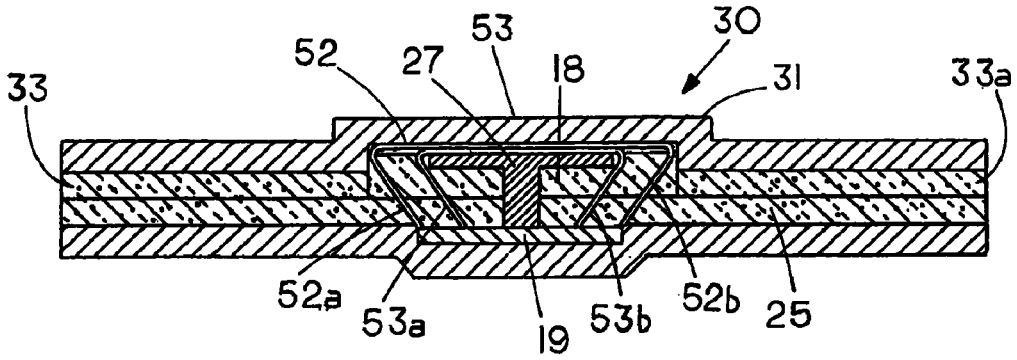
FIG. 8 shows a cross sectional view of an inline connector containing a viscous sealant therein.

Thus the embodiment of FIGS. 6 and 7 may be used with both hot and ground wires of an electrical circuit while also allowing to one to use end-to-end connection, a side-by-side connection or a branch connection in a single connector. Although the examples are shown with multiple passageways each located in an end-to-end condition with other passageways it is envisioned that a single passageway located in an end-end condition with another single passageway is within the spirit and scope of the invention FIG. 8 shows a sectional view of the inline push-in wire connector 30 revealing a viscous sealant 25 located in passageway 33 and 33*a* with the passageways located in substantially axial alignment. Located in chamber 18 is a first resilient member 52 having a first blade 52*a* for engaging an electrical wire in passageway 33 and a second resilient member 53 having a first blade 53*a* for engaging an electrical wire in passageway 33. On the opposite side of wire stop 27 first resilient member 52 has a second blade 52*b* for engaging an electrical wire in passageway 33 and the second resilient member 53 has a third blade 53*b* for engaging a wire in passage way 33*a*.

Figure 8A:
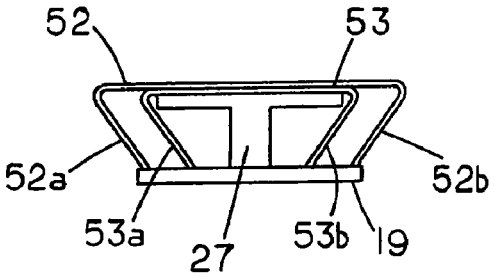
FIG. 8A shows an isolated view of the resilient members in the inline connector of FIG. 8.
Figure 8B:
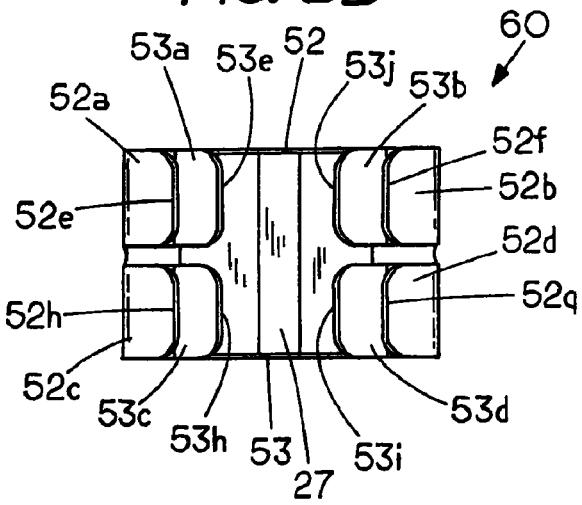
FIG. 8B shows an isolated bottom view of the resilient members of FIG. 8.

The resilient members 52 and 53 are shown in isolation and side view in FIG. 8A and in isolation and in a bottom view in FIG. 8B. FIG. 8B reveals that resilient member 52 includes a first blade 52*a* on one end and a second blade 52*b* on the opposite end. Resilient member 52 also includes a third blade 52*c* on one end and a fourth blade 52*d* on the opposite side with each of the blades being cantilevered from resilient member 52. Similarly, resilient member 53 includes a first blade 53*a* on one end and a second blade 53*b* on the opposite end. Resilient member 53 also includes a third blade 53*c* on one end and a fourth blade 53*d* on the opposite side with each of the blades being cantilevered from resilient member 53. A tee shaped wire stop 27 supports the resilient members in a wire engaging position in housing 53 as illustrated in FIG. 8. FIG. 8 and FIG. 8A show a bus strip 19 extends beneath the wire engaging edges located at the end of each of the blades, while the bus strip has been left out of FIG. 8B for purposes of clarity.

It will be noted that each of the blades includes a wire contact edge. That is blade 52*a* includes a wire contact edge 52*e*, blade 53*a* includes a wire contact edge 53*e*, blade 52*b* includes a wire contact edge 52*f*, blade 53*b* includes a wire contact edge 53*j*, blade 52*c* includes a wire contact edge 52*h*, blade 53*c* includes a wire contact edge 53*h*, blade 53*d* includes a wire contact edge 53*i*, and blade 52*d* includes a wire contact edge 52*q*. In the embodiment shown the resilient members 52 and 53 are electrical conductors, however, it is within the spirit and scope of the invention to have resilient members 52 and 53 as non-electrical conductors and rely on the bus strip 19 to form the electrical connection between the electrical wires in the passageways. Likewise it is also within the scope of the invention to use only the resilient members as a bus strip.

Figure 9:
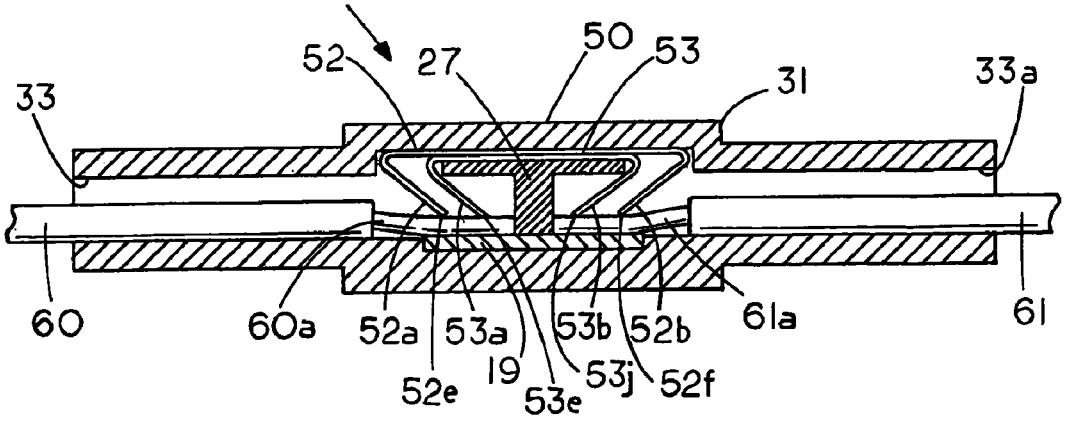
FIG. 9 shows the inline wire connector of FIG. 8 with two electrical wires held in an inline electrical connection.

To illustrate the in line wire engagement reference should be made to FIG. 9 which shows the push-in wire connector 30 with the resilient members 52 and 53 in a wire engaging condition without the sealant therein. Resilient member 52 is shown having a wire engaging edge 52*e* forcing bared wire end 60*a* of wire 60 into electrical engagement with bus strip 19. In addition wire engaging edge 53*e* of resilient member 53 is also shown forcing bared wire end 60*a* of wire 60 into electrical engagement with bus strip 19. On the other side of wire stop 27 the wire engaging end 53*j* of resilient member 53 and the wire engaging end 52*f* of resilient member 52 are shown holding the bared ends 61*a* of wire 60 in electrical contact with bus strip 19. While two resilient members are shown in parallel condition, if desired only one may be used. Thus a first resilient member 52 having a first blade 52*a* normally extending at least partially across the passageway 33 in the absence of an electrical wire therein, the first blade

52*a* having a wire contact edge 52*e* for cooperating with the bus strip 19 to form a sealant covered electrical wire connection in the first wire passageway. Similarly, the first resilient member has a second blade 52*b* normally extending at least partially across opposite passageway 33*a* in the absence of an electrical wire therein, the second blade 52*b* having a wire contact edge 52*f* for cooperating with the bus strip 19 to form a sealant covered electrical wire connection in the second wire passageway whereby a wire located in first wire passageway 33 and a wire located in the second passageway 33*a* are in line with one another.

FIG. 7 shows a third wire passageway 34 is located in side-by-side relationship to wire passageway 33. Similarly, a fourth passageway 34*a* extends from the opposite side of the housing 30 with the fourth passageway 34*a* in substantial axial alignment with the third passageway 33. The resilient member 52, which is shown in bottom view in FIG. 8B, reveals the four blades extending in a cantilever manner therefrom. In operation third blade 52*c* normally extends at least partially across third passageway 34 in the absence of an electrical wire therein, similarly a fourth blade 52*d* normally extends at least partially across fourth passageway 34*a* in the absence of an electrical wire therein, the third blade 52*c* having a wire contact edge 52*h* for cooperating with the bus strip 19 to form a sealant covered electrical wire connection in the wire passageway 3*d* and the fourth blade 52*d* having a wire contact edge 52*q* for cooperating with the bus strip 19 to form a sealant covered electrical wire connection therein. In addition wire contact edge 53*h* and 53*i* also generate a resilient force against a wire located thereunder. A feature of having a common bus strip 19 for each of passageway is that it provides multiple options for connecting electrical wires. That is wires can be connected either in an inline condition i.e., using opposing passageways 33 and 33*a* or 34 and 34*a* that are in substantial axial alignment or in a branch condition by using the passageways 33 and 34 or passageways 33*a* and 34*a* that are located in a side by side condition, thus providing multiple options for connection electrical regardless of the orientation of the electrical wires.

A feature of the use of two resilient members in the push-in wire connector is that it enables one to apply electrical contact force on two portions on the bared end of the wire to thereby increase the likelihood of obtaining a low resistance electrical contact between the wire and the bus strip. Thus in some applications only one set of resilient members may be used in others two or more sets of resilient members may be used to ensure that a low resistance electrical connection can be formed between the bus strip and the bared end of the wire or wires therein. Thus a first resilient member and a second resilient member may each have a companion resilient member to thereby increase a force contact area on a wire located thereunder.

While the examples of the invention have been shown with the axial passageway in substantial axial alignment it is envisioned that one may want to have the opposed axial passages located at less than 180 degrees angle from each other but more than 90 degree angle to each other and still obtain the benefits of the inventions described herein.

We claim:

1. An inline push-in wire connector comprising:

a housing having a chamber therein;

a waterproof sealant located in said chamber;

a first wire passageway extending from a first side of the housing;

a second wire passageway extending from the opposite side of the housing with said second wire passageway in substantial axial alignment with said first wire passageway;

a bus strip;

a first resilient member, said first resilient member having a first blade normally extending at least partially across said first passageway in the absence of an electrical wire therein, the first blade having a wire contact edge for cooperating with the bus strip to form a sealant covered electrical wire connection in the first wire passageway, said first resilient member having a second blade normally extending at least partially across said second passageway in the absence of an electrical wire therein, the second blade having a wire contact edge for cooperating with the bus strip to form a sealant covered electrical wire connection in the second wire passageway whereby a wire located in said first wire passageway and a wire located in said second passageway are in line with one another and in electrical connection with each other.

2. The inline push-in wire connector of claim 1 comprising:

a third passageway extending from the first side of the housing;

a fourth passageway extending from the opposite side of the housing with said fourth passageway in substantial axial alignment with said third passageway, said first resilient member having a third blade normally extending at least partially across said third passageway in the absence of an electrical wire therein, said first resilient member having a fourth blade normally extending at least partially across said fourth passageway in the absence of an electrical wire therein, the third blade having a wire contact edge for cooperating with the bus strip to form a sealant covered electrical wire connection in the third wire passageway and the fourth blade having a wire contact edge for cooperating with the bus strip to form a sealant covered electrical wire connection located in the fourth wire passageway whereby either or both an inline electrical connection or a branch electrical connection can be formed therein.

3. The inline push-in wire connector of claim 2 including:

a fifth wire passageway extending from the first side of the housing;

a sixth wire passageway extending from the opposite side of the housing with said fifth wire passageway in substantial axial alignment with said second wire passageway;

a further bus strip;

a second resilient member, said second resilient member having a first blade normally extending at least partially across said fifth passageway in the absence of an electrical wire therein, the fifth blade having a wire contact edge for cooperating with the further bus strip to form a sealant covered electrical wire connection in the fifth wire passageway, said second resilient member having a second blade normally extending at least partially across said second passageway in the absence of an electrical wire therein, the second blade of said second resilient member having a wire contact edge for cooperating with the further bus strip to form a sealant covered electrical wire connection in the sixth wire passageway.

4. The inline push-in wire connector of claim 3 comprising:

a seventh passageway extending from the first side of the housing;

an eight passageway extending from the opposite side of the housing with said seventh passageway in substantial axial alignment with said eight passageway, said second resilient member having a third blade normally extending at least partially across said seventh passageway in the absence of an electrical wire therein, said second resilient member having a fourth blade normally extending at least partially across said eighth passageway in the absence of an electrical wire therein, the third blade having a wire contact edge for cooperating with the further bus strip to form a sealant covered electrical wire connection in the seventh wire passageway and the fourth blade having a wire contact edge for cooperating with the further bus strip to form a sealant covered electrical wire connection located in the eighth wire passageway whereby either or both an inline electrical connection or a branch electrical connection can be formed therein.

5. The inline push-in wire connector of claim 1 including a wire stop located proximate an end of the first wire passageway and the second wire passageway.

6. The inline push-in wire connector of claim 1 wherein the waterproof sealant comprises a viscous sealant and said first resilient member and said second resilient member each having a companion resilient member to thereby increase a force contact area on a wire located thereunder.

7. The inline push-in wire connector of claim 6 wherein the waterproof sealant is an electrical insulator.

8. The inline push-in wire connector of claim 1 wherein each of the blades of the resilient member are cantilevered therefrom and each of the resilient members are electrical conductors.

9. The inline push-in wire connector of claim 4 wherein each of the wire passageways located in the first side of the housing are located in substantial axial alignment with a passageway on the opposite side of the electrical housing.

10. The inline push-in wire connector of claim 4 wherein each of the passageways located on a one side of the housing are located in a side-by-side condition.

11. The inline push-in wire connector of claim 4 wherein the first bus strip and the further bus strip are electrically isolated from each other by an electrically insulating divider.

12. The inline push-in wire connector of claim 4 including at least four passageways on one side of the housing and at least four passageways on the opposite side of the housing with each of the passageways in substantial axial alignment and at least one passageway on one side of the housing electrically isolated from an adjacent passageway on the one side of the housing.

13. An inline push-in wire connector comprising:

a housing having a chamber therein; a first wire passageway extending from a first side of the housing; a second wire passageway extending from the opposite side of the housing with said second wire passageway forming an inline condition for a wire located in said first wire passageway or said second passageway; a bus strip; a first resilient member, said first resilient member having a first blade normally extending at least partially across said first passageway in the absence of an electrical wire therein, the first blade having a wire contact edge for cooperating with the bus strip to form an electrical wire connection in the first wire passageway, said first resilient member having a second blade normally extending at least partially across said second passageway in the absence of an electrical wire therein, the second blade having a wire contact edge for cooperating with the bus strip to form an electrical wire connection in the second wire passageway whereby a wire located in each of the first wire passageway and a further wire located in the second passageway are in an inline condition.

14. The inline push-in wire connector of claim 13 wherein the first passageway and the second passageway are separated by a barrier and an angle of the first passageway with respect to the second passageway is 180 degrees or less with said first wire passageway but greater than 90 degrees.

15. The inline push-in wire connector of claim 14 wherein the inline push-in wire connector includes a third passageway with the third passageway located in a spaced but parallel condition to either said first passageway or said second passageway or both said first passageway and said second passageway.

* * * * *